US008141472B1

(12) United States Patent
Grove et al.

(10) Patent No.: US 8,141,472 B1
(45) **Date of Patent: *Mar. 27, 2012**

(54) VEHICLE WINDOW COVER

(75) Inventors: Lee A. Grove, Mishawaka, IN (US); Donald F. Rhoad, Bamberg, SC (US)

(73) Assignee: Defense Consulting Services, Inc., Bamberg, SC (US)

( * ) Notice: Subject to any disclaimer, the term of this patent is extended or adjusted under 35 U.S.C. 154(b) by 21 days.

This patent is subject to a terminal disclaimer.

(21) Appl. No.: 12/774,515

(22) Filed: May 5, 2010

Related U.S. Application Data

(63) Continuation-in-part of application No. 11/757,863, filed on Jun. 4, 2007, now Pat. No. 8,056,463, which is a continuation-in-part of application No. 11/333,783, filed on Jan. 17, 2006, now Pat. No. 7,225,718.

(60) Provisional application No. 60/644,116, filed on Jan. 14, 2005.

(51) Int. Cl.
*F41H 5/14* (2006.01)

(52) U.S. Cl. ..... 89/36.09; 89/36.01; 89/36.08; 89/929; 89/930

(58) Field of Classification Search ..... 89/36.01, 89/36.04, 36.07, 36.08, 39.09, 36.11, 36.12, 89/36.13, 36.14
See application file for complete search history.

(56) References Cited

U.S. PATENT DOCUMENTS

| | | | | |
|---|---|---|---|---|
| 4,005,662 | A * | 2/1977 | Kohn et al. | 109/16 |
| 4,326,445 | A | 4/1982 | Bemiss | |
| 4,934,246 | A | 6/1990 | Benson et al. | |
| 5,128,803 | A | 7/1992 | Sprafke | |
| 5,204,160 | A * | 4/1993 | Rouser | 428/167 |
| 5,315,915 | A | 5/1994 | Sprafke | |
| 5,452,641 | A | 9/1995 | Kariya | |
| 5,749,140 | A | 5/1998 | Polito et al. | |
| 6,178,451 | B1 | 1/2001 | Huitema et al. | |
| 2004/0016058 | A1 | 1/2004 | Gardiner et al. | |

* cited by examiner

*Primary Examiner* — Gabriel Klein
(74) *Attorney, Agent, or Firm* — Botkin & Hall, LLP

(57) ABSTRACT

A window cover for a military vehicle which includes armored plates angled away from an underlying vehicle window with reflectors, one of the reflectors being pivotable. The window cover allows an occupant of the vehicle to view outside the vehicle window as light is reflected off a viewing reflector to a stationary reflector and toward an occupant of the vehicle. A filter is placed between the viewing and stationary reflectors to filter out a portion of light reflected. The filter may also provide a collimation function.

6 Claims, 5 Drawing Sheets

VEHICLE WINDOW COVER

CROSS REFERENCE TO RELATED APPLICATIONS

This application is a continuation-in-part of application Ser. No. 11/757,863, filed Jun. 4, 2007 now U.S. Pat. No. 8,056,463, which is a continuation-in-part of Utility patent application Ser. No. 11/333,783, filed Jan. 17, 2006, issued Jun. 5, 2007 as U.S. Pat. No. 7,225,718, which claims priority and benefit of Provisional Application No. 60/644,116, filed Jan. 14, 2005, the disclosures of which are hereby incorporated by reference.

BACKGROUND OF THE INVENTION

Field of the Invention

U.S. Pat. No. 7,225,718 discloses a device for using reflectors to see out of a military vehicle window. The device uses an upper armored plate with reflective covering disposed on its underside. A lower reflector is placed below the upper plate and ahead of a lower armored plate. This configuration enables an occupant of the vehicle to see out windows of a military vehicle and remain protected from projectiles fired at the vehicle. While successful, the field of view as seen by the occupant of a vehicle is not adjustable because the reflectors are fixed in place. Also, light striking the lower reflector is redirected toward a vehicle occupant's eyes without being filtered.

SUMMARY OF THE INVENTION

The present invention is an improvement for a window cover used for viewing out of a window. The window cover has a first armored plate and a viewing reflector in front of the first armored plate. The viewing reflector is angled away from the window and reflects light directed toward the window. The viewing reflector is penetrable by a projectile fired at the vehicle toward the window. A second armored plate is in front of the window. The second armored plate has an inner surface and an outer surface. The inner surface faces the window at an angle relative to the window. A stationary reflector is secured to the inner surface of the second armored plate. The stationary reflector is opposite the viewing reflector so that at least a portion of the light striking the viewing reflector and reflected from it may be reflected off the stationary reflector through the window.

A filter for light is placed between the viewing and stationary reflectors. The filter filters out portions of light passing through it and may also include a collimator.

An object of the invention is to provide a window cover that has an adjustable field of view.

Another object of the invention is to provide a field of view similar to that of a traditional window.

Another object of the invention is to provide a filter for light that passes through a window cover for a vehicle.

Still other objects of the invention will become apparent upon reading the following description.

DETAILED DESCRIPTION OF INVENTION

Figure 1:
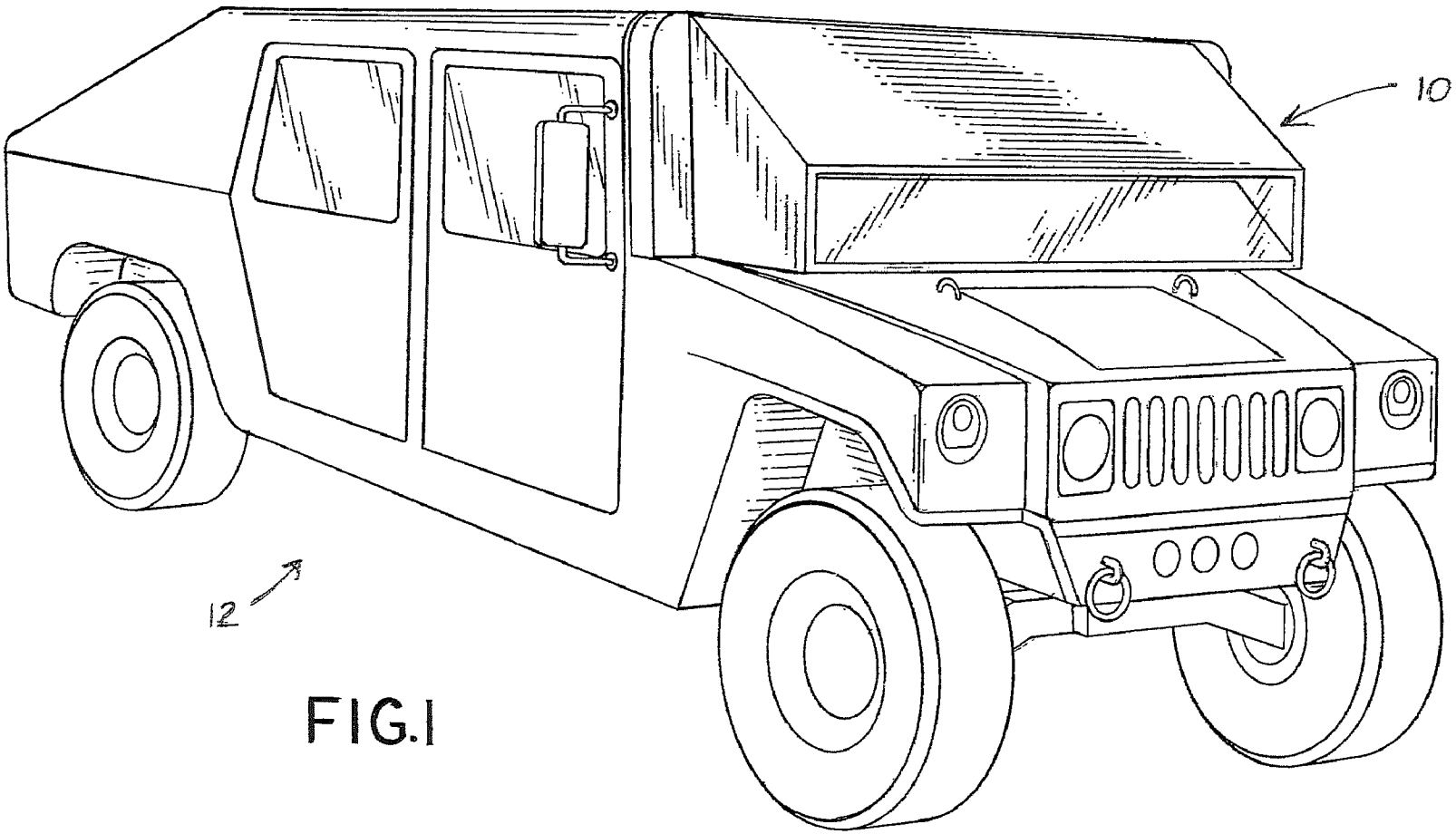
FIG. 1 is a perspective view of an embodiment of the window cover of this invention.
Figure 2:
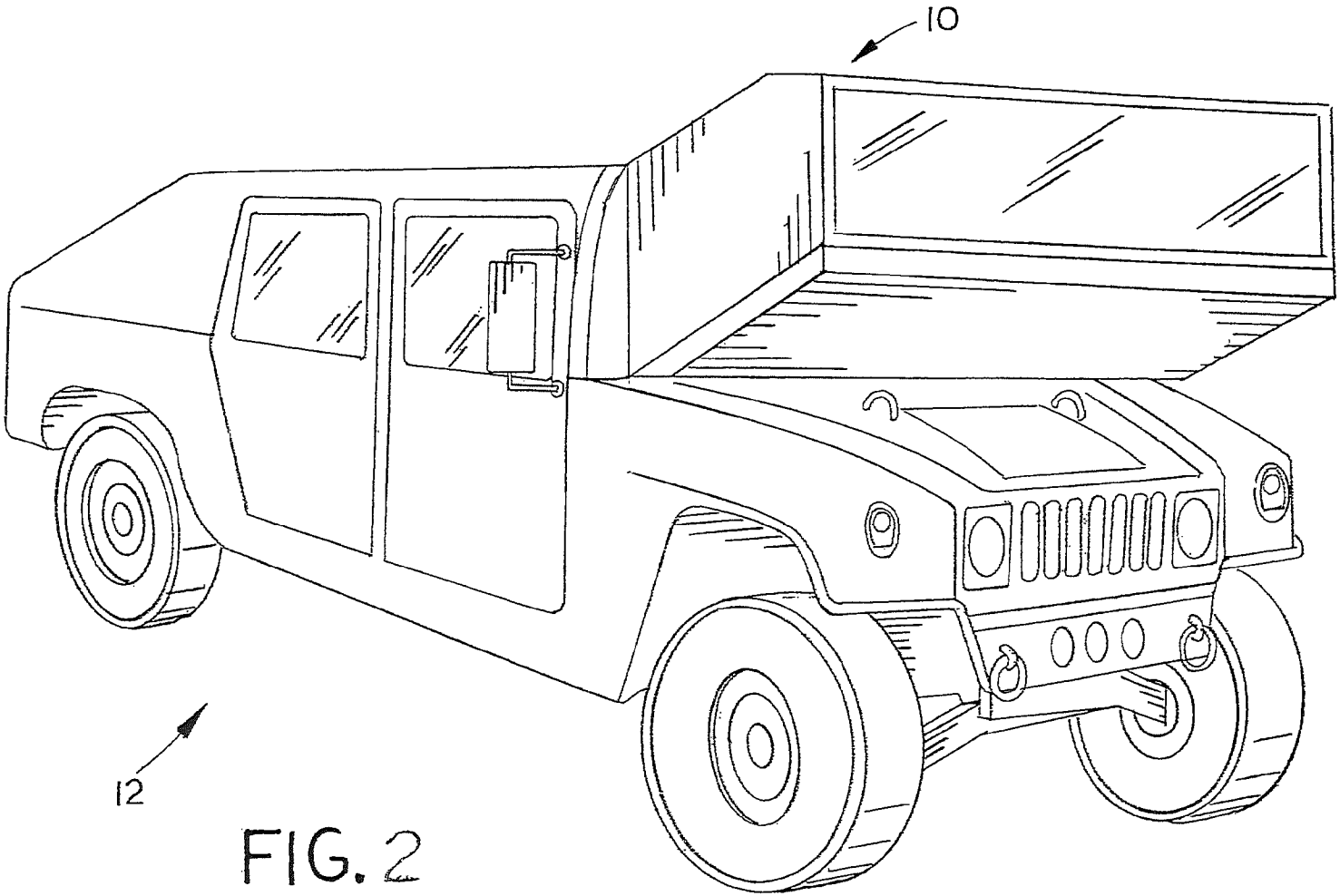
FIG. 2 is a perspective view of another embodiment the window cover of this invention.
Figure 3:
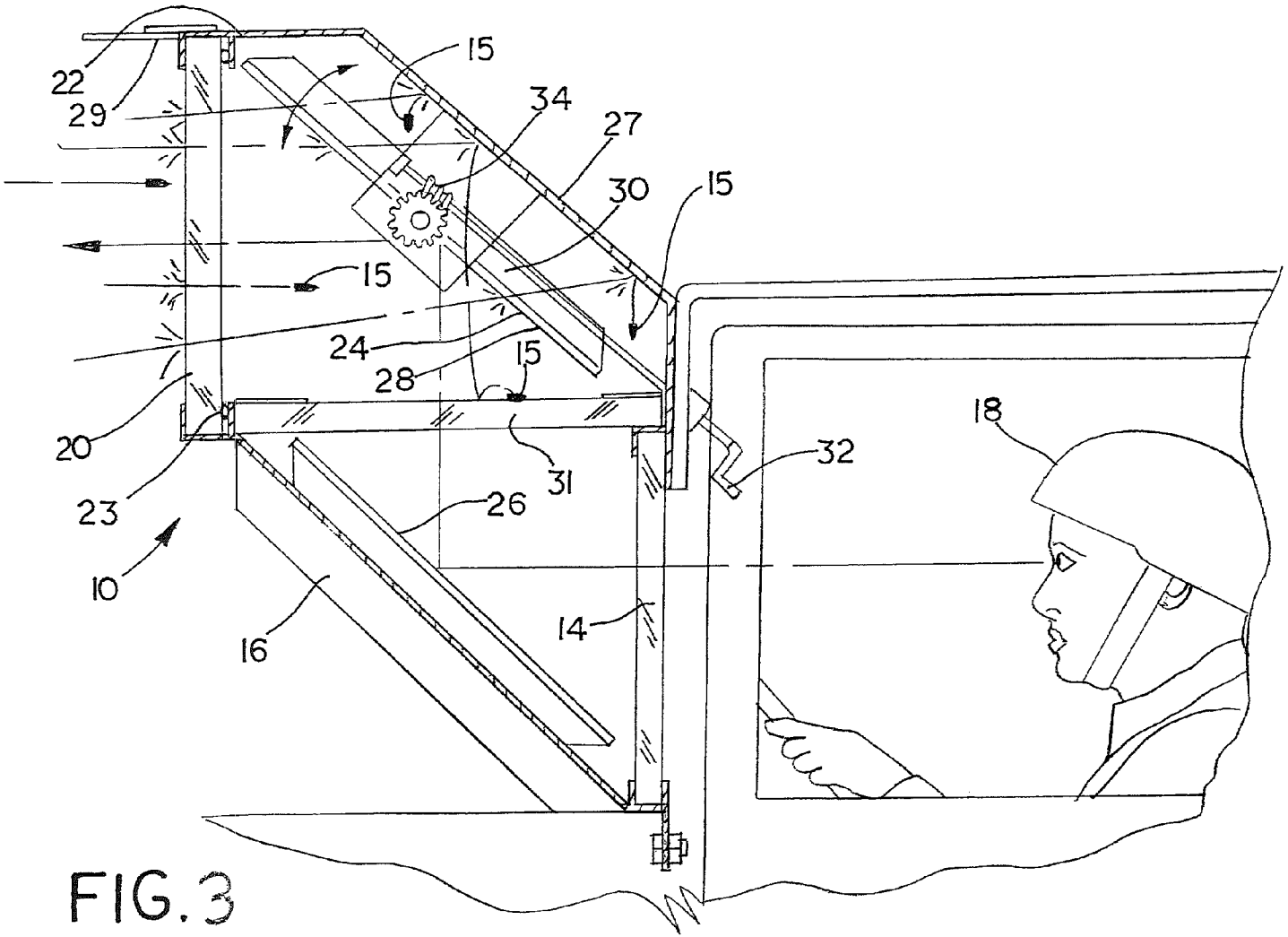
FIG. 3 is a sectional view of the embodiment of the window cover shown in FIG. 2.
Figure 4:
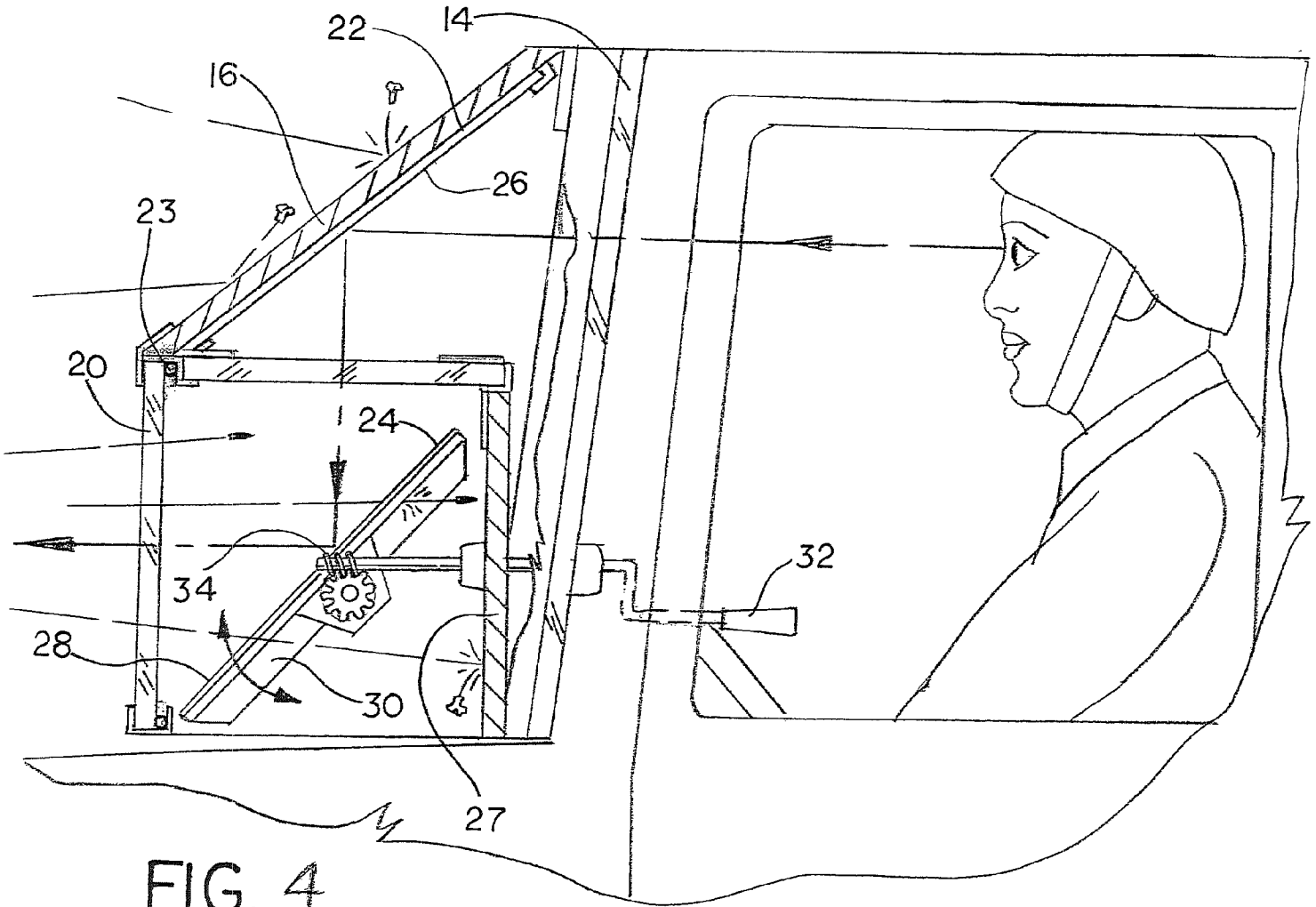
FIG. 4 is a sectional view of the embodiment of the window cover shown in FIG. 1.

A window cover 10 shown in FIG. 2 is attached to a military vehicle 12. The window cover 10 is used over a window 14, as shown in FIG. 2 of vehicle 12. The window cover 10 is removably mounted in place on the vehicle by suitable fasteners. As seen in FIGS. 3 and 4, an occupant 18 of the military vehicle 12 is able to utilize the window cover 10 to have an unobstructed view through the vehicle window 14 with protection from bullets 15 or similar projectiles fired at the window and the vehicle occupant. FIG. 3 shows one embodiment of the window cover of this invention and FIG. 4 shows another embodiment.

FIGS. 3 and 4 show the window cover 10 including a viewing window 20 that is mounted to a box 22. Window 20 is preferably of a plastic construction. An O-ring seal 23 is used around the perimeter of the viewing window 20 to prevent entry of water or sand into the box 22. Behind the viewing window 20 is a viewing reflector 24. The viewing reflector 24 is movable as shown in FIGS. 3 and 4. The viewing reflector 24 is opposite a stationary reflector 26 which does not move and has a mirrored reflective surface. In the embodiment shown in FIG. 3, the viewing reflector 24 is above the stationary reflector 26. In the embodiment shown in FIG. 4, the stationary reflector 26 is above the viewing reflector 24. The viewing reflector 24 in both embodiments is in front of a first armored plate 27, and the stationary reflector 26 is behind second armored plate 16. The viewing reflector 24 has reflective layer 28 which is preferably a polymer mirror or a polished metal mirror surface that is attached to a substrate 30. The substrate 30 is preferably made of aluminum honeycomb, lightweight foam, or plastic material that adds structural integrity to the reflective layer 28 of the viewing reflector 24. A light filter 31 is placed between the viewing and stationary reflectors 24, 26.

Figure 5:
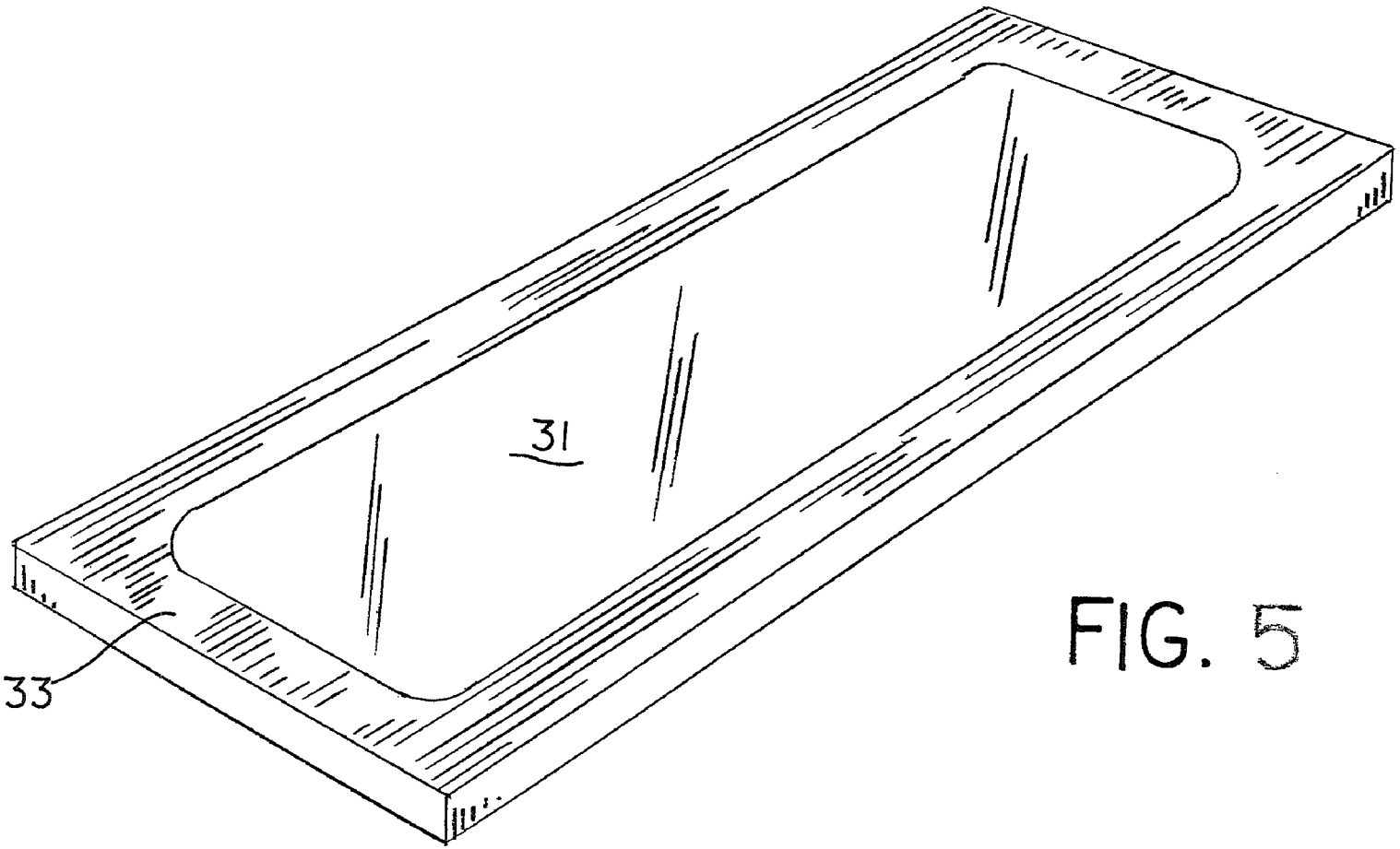
FIG. 5 is a perspective view of the collimator.

An occupant 18 of the military vehicle 12 can change his field of view by pivoting the viewing reflector 24. This may be done with a crank 32 attached to a worm gear assembly 34 as shown in FIGS. 3 and 4. Pivoting the viewing reflector 24 may also be accomplished by alternative means such as hydraulics, pneumatics, or cables. The light reflected from the viewing reflector 24 to the stationary reflector 26 passes through the filter 31. The filter 31 is made of a light filtering material which filters out portions of the light that may be harmful to the eyes of an occupant 18 of the vehicle. Another function of the filter 31 is to collimate light reaching the lower reflector to prevent the occupant from seeing extraneous objects. Extraneous objects are things which the occupant 18 would see when looking into the window cover that are not outside the vehicle itself. Examples of extraneous objects are parts of the inside of the sealed box 22 or mounting hardware for the viewing reflector 24. The collimating function of the filter 31 ensures that the light reaching the occupant's eyes is only that reflected from the viewing reflector 24 as opposed to light reflected from objects within the window cover 10, which would be distracting to an occupant. This provides a field of view to the occupant that approximates what he would see if looking through a traditional window. The collimation function of the filter 31 is achieved by painting the perimeter of the filter 31 with an opaque color that blocks all light in the painted area 33, which is shown in FIG. 5. Light may also be blocked by adding a layer of opaque material such as sheet metal over the filter to block light in what is shown as the painted area 33.

In the configuration shown in FIG. 2, a third reflector 29 may be used to enhance an occupant's 18 view of the ground near a vehicle. The third reflector 29, which is best seen in FIG. 3, is attached in front of the viewing reflector 24 and above the stationary reflector 26. The third reflector 29 can allow the occupant 18 to see the ground at some distance from the vehicle. The third reflector 29 reflects light from the ground closer to the vehicle than would enter the viewing window 20 without the third reflector 29. Light reflected from the ground near the vehicle 12 will be reflected to the stationary minor 26 and ultimately reach the occupant's 18 eyes.

During use, an occupant 18 looks through window 14 as would be done in the absence of the window cover 10 of this invention. Light that enters the viewing window 20 is reflected from the viewing reflector 24 to the stationary reflector 26 and then on to the occupant's 18 eyes. When the occupant 18 wishes to change the view he can see, he may change the position of the viewing reflector 24 by using the crank 32. The third reflector 29, placed above the viewing window 20 in the configuration shown in FIG. 2, will enhance the range of view available to the occupant 18 by allowing him to see objects close to the vehicle 12. Window 14 is bulletproof glass. Projectiles 15 fired at the vehicle 12 can pierce the viewing window 20 and continue through the viewing reflector 24 as shown in FIGS. 3 and 4. The projectiles 15 will then strike the first armored plate 27. The projectiles will leave holes in the upper reflector 24 that are the size of the projectile 15. This will allow a number of projectiles 15 to strike the viewing window 20 and the viewing reflector 24 without obstructing the occupant's 18 view.

The detailed description related herein is meant only to exemplify the preferred embodiment of the invention to enable those skilled in the art to make and use it. The subject invention is not limited to the details given, but may be modified within the scope of the following claims.

What is claimed is:

1. A window cover for covering a window of a vehicle, said cover comprising:

an upper armored plate having a top side, an underside, a forward end, and a rearward end, said forward end of said upper armored plate being farther from said window relative to said rearward end of said upper armored plate and said rearward end of said upper armored plate being nearer said window relative to said forward end of said upper armored plate, said rearward end of said upper armored plate being higher than said forward end of said upper armored plate with the underside of said upper armored plate at least partially extending below an upper edge of said window;

an upper reflector beneath said underside of said upper armored plate, said upper reflector having a forward end and a rearward end, said forward end of said upper reflector being farther from said window relative to said rearward end of said upper reflector and said rearward end of said upper reflector being nearer said window relative to said forward end of said upper reflector, said forward end of said upper reflector being lower than said rearward end of said upper reflector;

a lower armored plate located in front of said window and constituting means for stopping or deflecting a projectile, said lower armored plate having an upper end, a lower end, a front side, and a rear side, said front side facing away from said window, said rear side facing toward said window, said upper end of said lower armored plate being above said lower end of said lower armored plate, said upper end of said lower armored plate being farther from said window than said lower end of said lower armored plate being farther from said window than said lower edge of said armored plate;

a lower reflector located in front of said window and movable with respect to said window and said upper reflector, said lower reflector having a forward end and a rearward end, said forward end of said lower reflector being farther from said window relative to said rearward end of said lower reflector and said rearward end of said lower reflector being nearer said window relative to said forward end of said lower reflector, said forward end of said lower reflector being lower than said rearward end of said lower reflector, said lower reflector being positioned beneath said upper reflector and in front of said lower armored plate so that light reflected from said lower reflector strikes said upper reflector, said forward end of said upper reflector being higher than said rearward end of said lower reflector, whereby moving said lower reflector alters a view of objects outside of said vehicle as seen by an occupant of said vehicle.

2. A window cover as claimed in claim 1, wherein said lower reflector is spaced from said lower armored plate and movable with respect to said lower armored plate.

3. A window cover as claimed in claim 2, wherein said lower reflector is pivotable.

4. A window cover as claimed in claim 3, wherein said upper reflector is fixed with respect to said window and said upper and lower reflectors are substantially planar.

5. A window cover as claimed in claim 1, including a filter for filtering out a portion of light reflected from said upper reflector onto said lower reflector.

6. A window cover as claimed in claim 5, wherein said filter includes a collimator.

* * * * *